US009265339B2

(12) United States Patent
White

(10) Patent No.: US 9,265,339 B2
(45) Date of Patent: Feb. 23, 2016

(54) HAIRBRUSH WITH CLEANING TOOL

(71) Applicant: Jasper White, Kansas City, MO (US)

(72) Inventor: Jasper White, Kansas City, MO (US)

( * ) Notice: Subject to any disclaimer, the term of this patent is extended or adjusted under 35 U.S.C. 154(b) by 0 days.

(21) Appl. No.: 14/489,464

(22) Filed: Sep. 17, 2014

(65) Prior Publication Data

US 2015/0074929 A1 Mar. 19, 2015

Related U.S. Application Data

(60) Provisional application No. 61/878,602, filed on Sep. 17, 2013.

(51) Int. Cl.

| | |
|---|---|
| ***A46B 17/06*** | (2006.01) |
| ***A46B 9/02*** | (2006.01) |
| ***A46B 15/00*** | (2006.01) |

(52) U.S. Cl.

CPC ..... *A46B 17/06* (2013.01); *A46B 9/023* (2013.01); *A46B 15/0055* (2013.01)

(58) Field of Classification Search

CPC ..... A46B 17/06; A46B 9/023; A46B 15/00; A46B 15/0055; A46B 2200/104

See application file for complete search history.

(56) References Cited

U.S. PATENT DOCUMENTS

| | | | | |
|---|---|---|---|---|
| 3,172,139 | A * | 3/1965 | Wire | 15/160 |
| 4,709,475 | A * | 12/1987 | Phung | 30/31 |
| 6,382,216 | B1 * | 5/2002 | Clark | 132/148 |
| 8,418,700 | B2 * | 4/2013 | Guthans | 132/237 |
| 2005/0121049 | A1 * | 6/2005 | Rizzuto, Jr. | 132/147 |

* cited by examiner

*Primary Examiner* — Shay Karls

(74) *Attorney, Agent, or Firm* — Invention Protection Associates, LLC

(57) ABSTRACT

A brush and cleaning tool for removing hair accumulating in and between the bristles of the brush in a way that is non-strenuous for the user and non-damaging to the brush.

11 Claims, 5 Drawing Sheets

HAIRBRUSH WITH CLEANING TOOL

This non-provisional application claims the benefit of provisional application No. 61/878,602 filed Sep. 17, 2013.

BACKGROUND OF THE INVENTION

Typically, when using a hairbrush, some amount of human hair will detach from the user's scalp and deposit into the bristles of the brush. After extensive use of the brush, these hair deposits can become matted about the roots of the brush bristles and begin layering. Eventually, these hair deposits will affect the performance of the brush by reducing the length of bristle that remains exposed to penetrate hair that is to be styled. So, cleaning the bristles needs to be done periodically.

Often, combs, forks or other elongate, prong-like implements are used, improvisationally, to remove such deposited hair. However, since such devices were not made for the purpose of removing hair from brushes, they are often not dimensioned to neatly insert between the rows of brush bristles, where hair most deposits, and are often not constructed to be subjected to forces experienced in raking matted hair from brushes, they may tend to break or otherwise deform under the stresses of brush cleaning activity. Furthermore, since they were intended to accompany a hairbrush as a cleaning tool, a suitably configured improvisational device may not readily available for use at a given moment in which a user wants to clean his or her brush.

Consequently, the present inventor recognizes an outstanding need to provide a brush cleaning tool that is constructed to withstand the rigors of brush cleaning activity and, in fact, embody a design that make the brush cleaning exercise less strenuous than it typically has been previously. He further recognizes a need to provide such a cleaning tool and a brush that is made to conveniently house the tool within when the tool is not in use. The present invention substantially fulfills these needs.

SUMMARY OF THE INVENTION

The present invention generally relates to grooming instruments, and it is specifically directed to a hairbrush and self-stored cleaning tool assembly that enables easy lift removal of hair which deposits and accumulates between the rows of bristles formed along the hairbrush during use.

It is a first object of the present invention to provide a tool for removing hair from between the bristles of a hair brush in a manner that is non-strenuous for the user and that virtually eliminates the possibility of scratching the brush head, dislodging bristles or otherwise damaging the brush head in any way. In one aspect of the invention, the present cleaning tool features rubberized and beveled leading tip designed to almost effortlessly slide underneath matted hair without damaging the surface of the brush. In another aspect of the invention, the cleaning tool is telescopically expandable and has a diameter than enables it to comfortably fit between rows of bristles along the accompanying brush and to span beyond the full length of those rows so that its trail end is exposed to be handled by the user.

It is a second object of the invention to provide a hairbrush with an accompanying cleaning tool that is storable within the brush itself. In one aspect of the invention, as mentioned, the cleaning tool is retractable. In another aspect, the brush includes a retaining compartment that is formed either within the body of the brush head, along the surface of the brush head, or within the body of the brush handle. That compartment is dimensioned to retain the cleaning tool while in its retracted position.

DETAILED DESCRIPTION OF THE PREFERRED EMBODIMENTS

Figure 1:
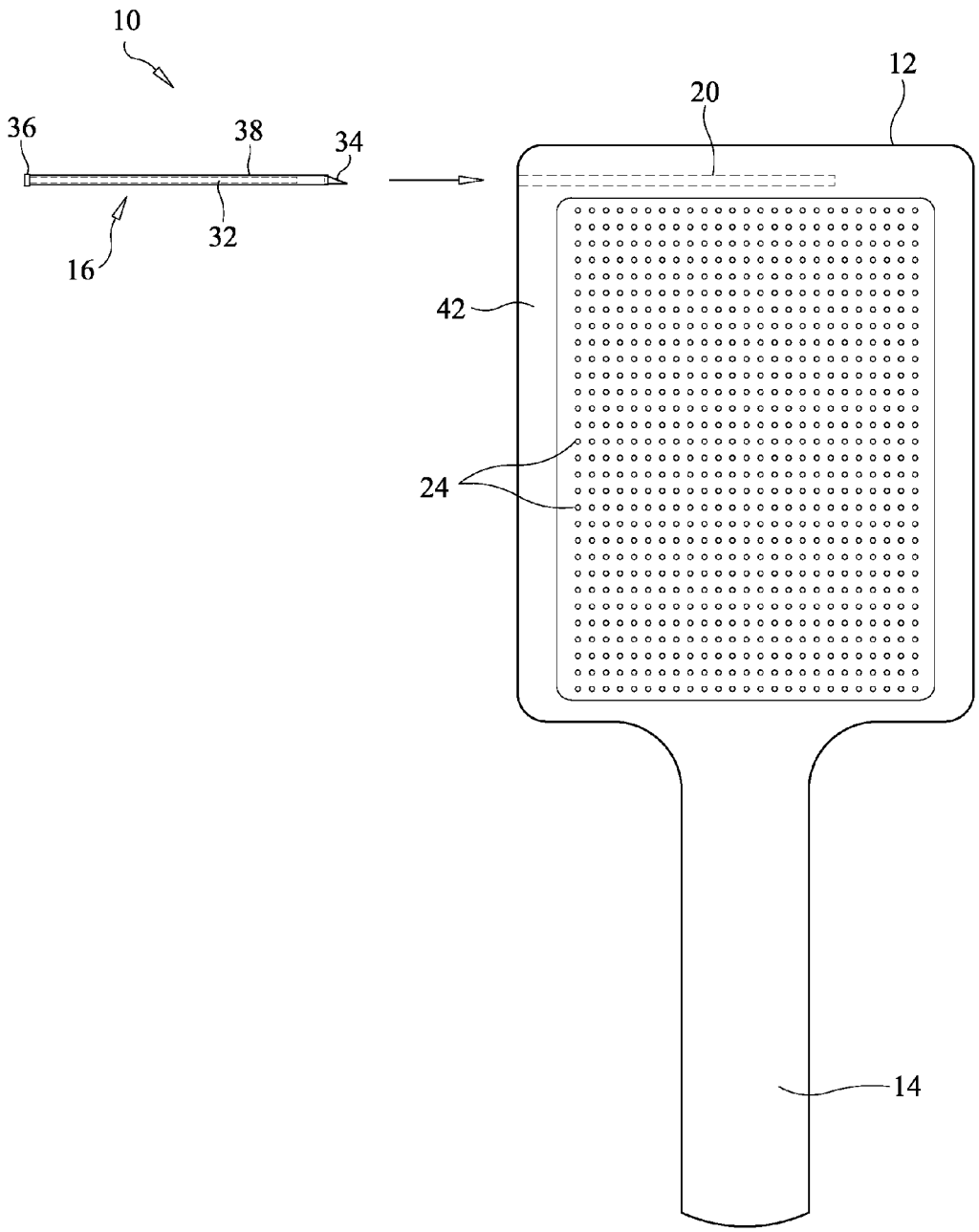
FIG. 1 is a bottom plan view of a hairbrush and cleaning tool assembly according to the present invention, the cleaning tool shown being substantially in its retracted position and fully removed from its retaining compartment which is a bore formed in the head portion of the hairbrush.

This disclosure, as defined by the claims that follow, related to an assembly which includes a hairbrush 10 and tool 16 for cleaning the brush 10 by way of inserting the tool 16 between the rows of bristles 24 along the inner face 42 of the brush head 12 and then lifting it away from the brush 10 to dislodge deposited hair. It should be noted that, although it is anticipated that various embodiments of a hairbrush 10 disclosed herein be of a type designed for human use, the invention is not so limited. Animal fur brushes are certainly within the spirit and scope of the invention, and the multiple embodiments of cleaning tool 16 disclosed herein are equally effective in removing both human and non-human hair from such brushes.

Figure 4:
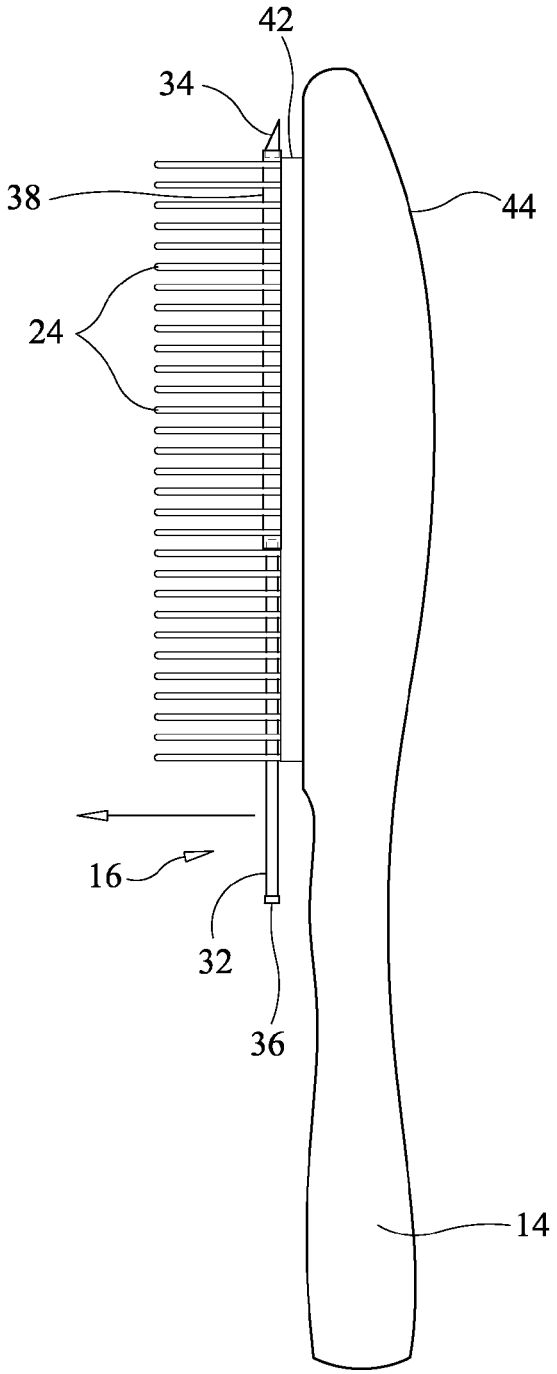
FIG. 4 is a side elevational view of a hairbrush and cleaning tool assembly according to the present invention, the cleaning tool shown being substantially in its extended position and inserted between the bristles of the hairbrush.
Figure 5:
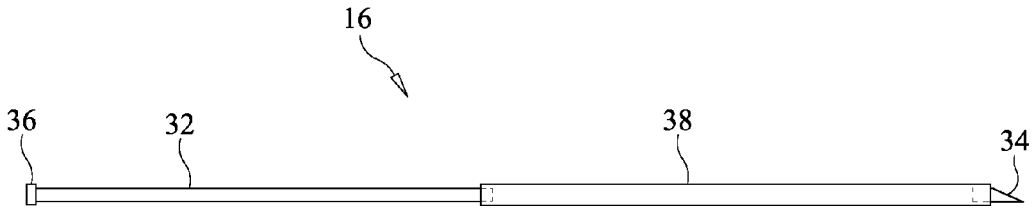
FIG. 5 is a side elevational view of the cleaning tool of FIG. 1 shown being in its fully extended position.
Figure 6:
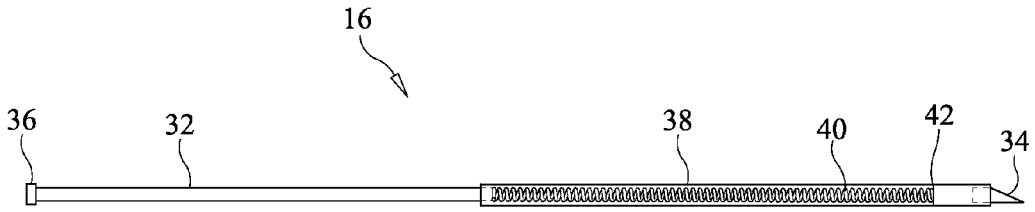
FIG. 6 is a side elevational view of a spring-loaded cleaning tool according to the present invention, the cleaning tool being shown being in its fully extended position.

As most clearly shown in FIGS. 5 & 6, preferred embodiments of the cleaning tool 16 are defined by an elongate tube and shaft assembly. More specifically, a cylindrical tube 38 has a rubberized tip 34 projecting from its lead end. Telescopically slidable within the tube 38 is a shaft 32 (which may or may not be a hollow cylinder) having a finger grip 36 at its trail end. The tube 38 and shaft 32 are both fabricated of rigid material such as metal, hard plastic or wood. The tip 34 is fabricated of less rigid rubber material, and it is beveled to enable it to pierce through and wedge underneath tufts of hair deposits when the tool 16 is inserted along the inner face 42 of the brush head 12, as shown in FIG. 4. The trail end of the tip 34 is plugged into the hollow tube 38. The cross-sectional dimension (diameter) of the tube 38 should approximate the space between rows of bristles 24 along the accompanying hairbrush 10.

It should be noted that, although the cleaning tool is described and shown as a tube and shaft assembly, in an alternative embodiment, it could be formed simply by a single tube (or shaft) that has a rubberized tip at its lead end.

Figure 2:
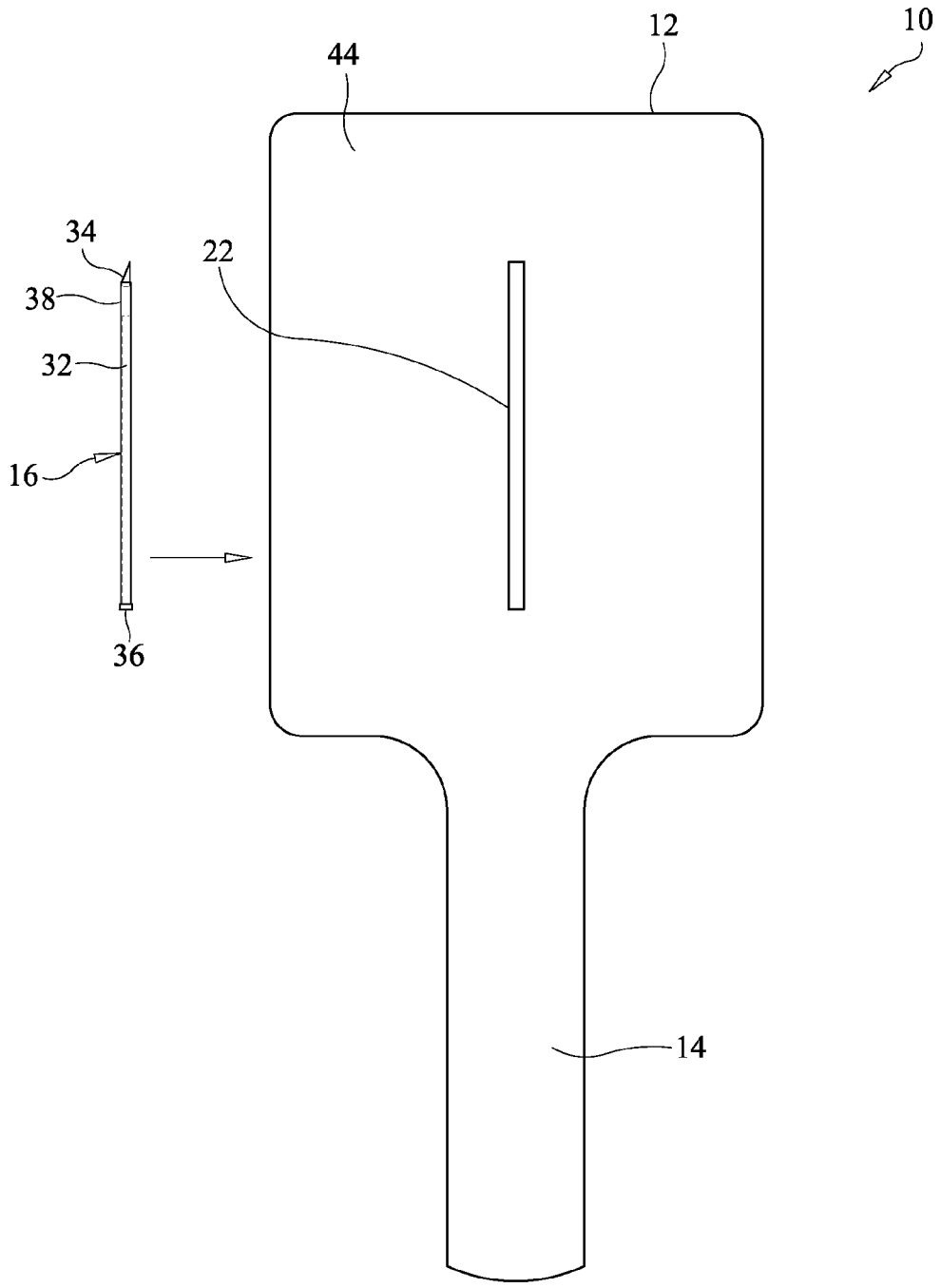
FIG. 2 is a top plan view of a hairbrush and cleaning tool assembly according to the present invention, the cleaning tool shown being substantially in its retracted position and fully removed from its retaining compartment which is a recess formed in the head portion of the hairbrush.
Figure 3:
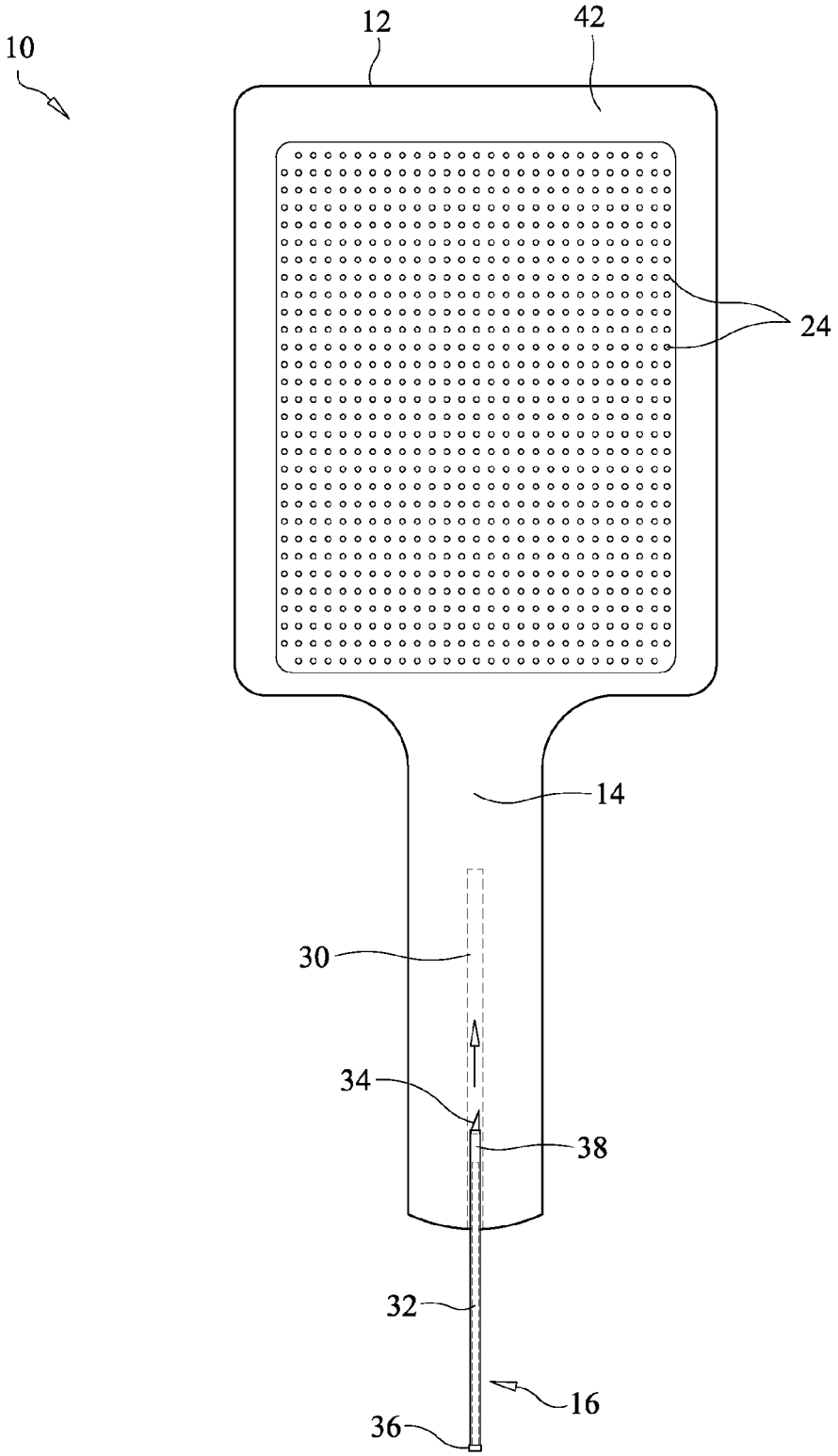
FIG. 3 is a bottom plan view of a hairbrush and cleaning tool assembly according to the present invention, the cleaning tool shown being substantially in its retracted position and partially inserted into its retaining compartment which is a bore formed in the handle portion of the hairbrush.

As shown in FIGS. 1-3, the brush 10 is formed by a handle portion 14 and a head portion 12. The head 12 has an inner face 42, along which rows of bristles 24 are formed, and an opposing outer face 44. In one embodiment depicted in FIG. 1, a bore 20 is formed within the body of the head 12. This bore 20 serves a retaining compartment in which the cleaning tool 16 can be stored. In another embodiment depicted in FIG. 3, the retaining compartment is a similar bore 30 formed in the handle 14 of the brush 10. In both such cases, the diameter of the bore 20, 30 is such that the tool 16 is a low tolerance fit inside of it, and the length of the bore 20, 30 is such that the fully inserted tool 16 slightly protrudes out of it so that it can be pinched, at the finger grip 36, and pulled by a user's thumb and index finger.

Although not shown in the accompany drawings, a variety of mechanisms can be employed for securely retaining the tool 16 within the retaining compartment 20, 30. For example, a magnet (not shown) can situated at the pit of the compartment 20, 30 to attract the metallic tool 16 with sufficient force to prevent the tool 16 from sliding out of the compartment 20, 30 due merely to gravitational force. For another example, a rubber flange (not shown) can be placed at the entrance of the bore 20, 30 to apply enough friction to the tool 16, as it slides therethrough, to prevent the tool 16 from inadvertently sliding out of the compartment 20, 30.

Alternatively, as shown in FIG. 2, the tool retaining compartment can be a trough or recess 22 formed in the outer face 44 of the brush head 12. A compartment 22 of this type is for pressing a retractable version of the cleaning tool 16 into. Therefore, the semi-cylindrical recess 22 should be dimensioned slightly wider than the diameter of the tube portion 38 of the tool 16, and should be shorter in length than is the fully extended tool 16. This sizing especially causes a spring-loaded version of the cleaning tool 16 to self-retain when pressed into the recess 22.

Preferably, the length of the cleaning tool 16 spans more than the length of bristle rows 24, but can be retracted to fit into a shorter recess-type retaining compartment 22, for example. Accordingly, in the embodiment of the cleaning tool 16 depicted in FIG. 6, the shaft 32 is spring-loaded. More specifically, the shaft 32 fits telescopically within the larger-diametered tube 38, and a spring 40 is housed within the tube 38. One end of the spring 40 abuts a flange or full partition 42 formed within the tube 38, and its other end abuts the lead end of the shaft 32. This causes the cleaning tool 16 to be spring-biased toward an extended length position, but allows it to be contracted, by intentional application of compression force, into a shorter posture. The spring 40 should have a spring force that allows it remain fully extended when compressive forces such as the friction applied to the tool tip 34 when it is slid against the brush surface when it is inserted underneath lodged hair or the resistance encountered by the tip 34 as it slides through lodged hair or pierces through a tuft of bristles 24 are acting upon the spring 40. Yet, that spring force should permit the tool 16 to retract, with relative ease, as the tool 16 is being inserted into a holding compartment 20, 22, 30 formed within the brush head 12 or handle 14.

An inward projecting flange (not shown) at the trail end of the tube 38 and an outward projecting flange (not shown) residing at the lead end of the shaft 32 cooperate to prevent the two pieces from fully separating.

In yet another embodiment of the present invention (not shown), the brush handle is detachable from the brush head, and a cleaning tool (typically, of the single shaft embodiment mentioned above) is mounted at the end of the handle. In this embodiment, the brush head has a bore formed within it for receiving the cleaning tool while the handle and head are attached. Head-handle attachment is accomplished by threaded engagement, typically, but can be by any connecting means known to those of ordinary skill in the art. Although it is contemplated that the cleaning tool would be permanently affixed to the brush handle in this particular embodiment, in a similar alternative embodiment, the tool would be detachably affixed to the handle by way of threaded engagement as well.

It is understood that substitutions and equivalents for and combinations of various elements set forth above may be obvious to those skilled in the art and may not represent a departure from the spirit of the invention. Therefore, the full scope and definition of the present invention is to be set forth by the claims that follow.

What is claimed is:

1. A hairbrush and cleaning tool assembly comprising:

a hairbrush comprising a handle and a head, wherein the head has inner and outer faces, wherein rows of bristles project from the inner face;

a cleaning tool for removing hair that is deposited between adjacent rows of bristles, wherein the tool comprises a shaft and a tube in telescopic relation with the shaft, wherein the tool is spring-loaded to bias the tube and shaft toward an extended position, and compression force retracts the shaft into the tube.

2. The assembly of claim 1, wherein said shaft has a cross-sectional dimension approximating the space between adjacent rows of bristles.

3. The assembly of claim 1, wherein a finger grip is disposed along said shaft.

4. A hairbrush and cleaning tool assembly comprising:

a hairbrush comprising a handle and a head that is attachable at an end of the handle, wherein the head has inner and outer faces, wherein rows of bristles project from the inner face, and wherein a retaining compartment is formed within the hairbrush;

a cleaning tool for removing hair that is deposited between adjacent rows of bristles, wherein the tool substantially fits within the retaining compartment and comprises a shaft having an end tip that is less rigid than the shaft and a tube in telescopic relation with the shaft, wherein the tool is spring-loaded to bias the tube and shaft toward an extended position, and compression force retracts the shaft into the tube.

5. The assembly of claim 4, wherein said tool tip is beveled.

6. The assembly of claim 4, wherein said shaft has a cross-sectional dimension approximating the space between adjacent rows of bristles.

7. The assembly of claim 4, wherein a finger grip is disposed along said shaft.

8. The assembly of claim 4, wherein said retaining compartment is defined by a bore formed within the body of said head.

9. The assembly of claim 8, wherein said tool is threadedly engageable within said retaining compartment.

10. The assembly of claim 4, wherein said retaining compartment is defined by a bore formed within said handle.

11. The assembly of claim 4, wherein said retaining compartment is defined by a recess formed in said outer face.

* * * * *